United States Patent [19]

Kern et al.

[11] Patent Number: 4,865,084

[45] Date of Patent: Sep. 12, 1989

[54] TAPE WHEEL FOR WEFT THREAD INSERTION AT A WEAVING MACHINE

[75] Inventors: Heiner Kern, Seuzach; Rudolf Heller, Zürich, both of Switzerland

[73] Assignee: Contraves AG, Zürich, Switzerland

[21] Appl. No.: 319,060

[22] Filed: Mar. 6, 1989

[30] Foreign Application Priority Data

Mar. 9, 1988 [CH] Switzerland ..... 885/88

[51] Int. Cl.[4] ..... D03D 47/12

[52] U.S. Cl. ..... 139/449; 474/152

[58] Field of Search ..... 139/449, 446, 443; 474/152, 161, 164, 180; 74/449

[56] References Cited

U.S. PATENT DOCUMENTS 3,987,822 10/1976 Freisler ..... 139/449

FOREIGN PATENT DOCUMENTS 0191188 8/1986 European Pat. Off. .

629859 5/1982 Switzerland .

*Primary Examiner*—Henry S. Jaudon

*Attorney, Agent, or Firm*—Werner W. Kleeman

[57] ABSTRACT

The wheel body of a tape wheel possesses two outer half shells which are fastened to the wheel hub. The two outer half shells are arranged in conically inclined relationship to one another with respect to a connecting plane and form a wheel rim by means of annular wall parts. Within the wheel body there may be located an inner stiffening shell which diagonally extends toward the exterior from one flange of the wheel hub to a free end of the other outer half shell. The inner stiffening shell abuts against the annular wall parts by means of an annular shell portion. The transverse or axial stiffness or rigidity of the wheel body and thus of the entire tape wheel is increased in a particularly advantageous manner.

11 Claims, 2 Drawing Sheets

FIG. 3
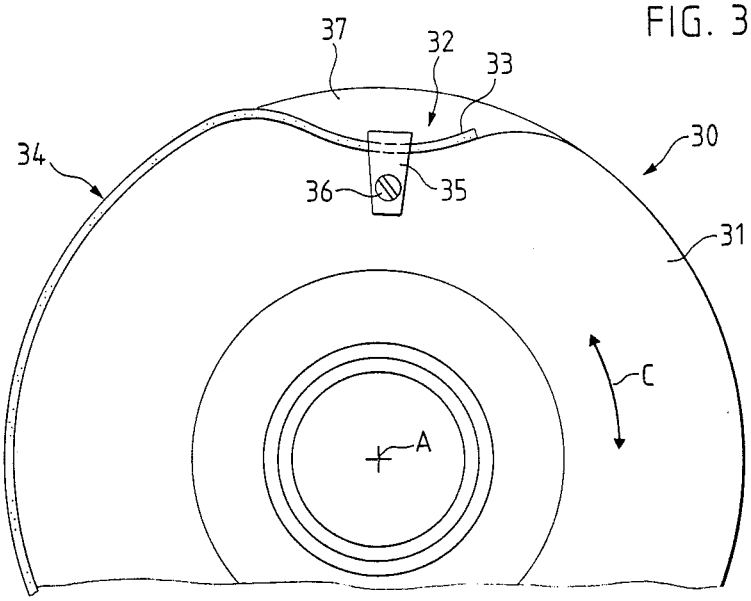
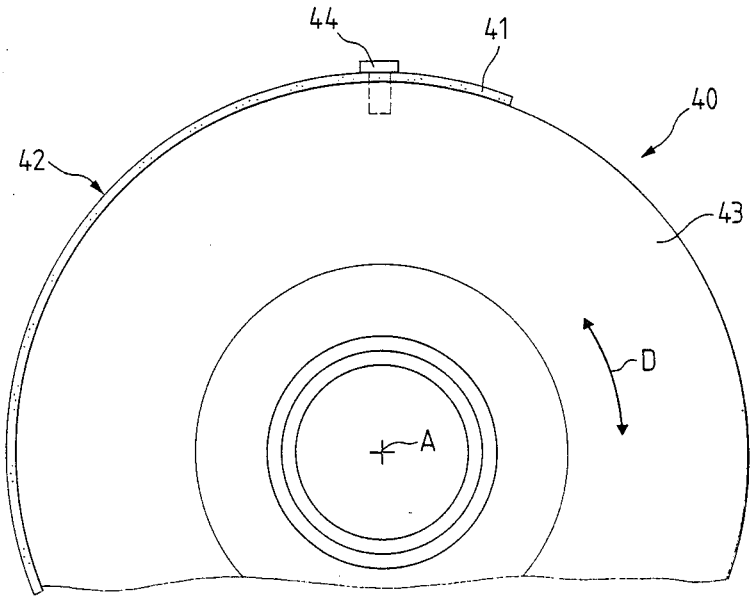
FIG. 4

TAPE WHEEL FOR WEFT THREAD INSERTION AT A WEAVING MACHINE

CROSS-REFERENCE TO RELATED PATENT APPLICATION

This application is related to the commonly assigned, copending U.S. patent application Ser. No. 07/319,349, filed Mar. 6, 1989, entitled "TAPE WHEEL FOR WEFT THREAD INSERTION AT A WEAVING MACHINE".

BACKGROUND OF THE INVENTION

The present invention broadly relates to weaving machines and, more specifically pertains to a new and improved construction of tape or strap wheel for weft thread insertion at a weaving machine.

Generally speaking, the tape or strap wheel of the present invention is of the type comprising a wheel hub or hub member, a wheel body or body member having a wheel rim or rim member and connected to the wheel hub, and a supporting part or element fastened to the wheel rim for receiving a weft thread insertion tape or strap. Furthermore, the tape or strap wheel comprises means for fastening the weft thread insertion tape or strap to the tape wheel and such tape wheel can be rotatably arranged.

In a known tape or strap wheel of the aforementioned type as disclosed, for example, in Swiss Patent No. 629,859, published May 14, 1982, there is provided an oscillatingly driven tape wheel for the weft thread insertion comprises a sort of honeycomb structure containing a plurality of cells arranged substantially parallel to the wheel axis. Furthermore, the wheel body is closed at each of both sides by a respective circular plate and is operatively connected to the wheel hub. However, the stiffness or rigidity and the low mass moment of inertia required for modern high-performance or high-capacity weaving machines are not sufficiently ensured in this prior art tape wheel.

SUMMARY OF THE INVENTION

Therefore, with the foregoing in mind it is a primary object of the present invention to provide a new and improved construction of a tape wheel for weft thread insertion at a weaving machine which is not afflicted with the aforementioned drawbacks and shortcomings of prior art constructions.

Another and more specific object of the present invention aims at providing a new and improved tape or strap wheel by means of which a substantial increase in stiffness and rigidity for a simultaneously low mass moment of inertia and space-saving arrangement at the weaving machine can be achieved Yet a further significant object of the present invention aims at providing a new and improved construction of a tape or strap wheel which is extremely simple in construction and design, very economical to manufacture, quite reliable in operation and requires only a minimum of maintenance or servicing.

Now in order to implement these and still further objects of the invention, which will become more readily apparent as the description proceeds, the tape or strap wheel of the present invention is, among other things, manifested by the features that the wheel body comprises two outer half shells structured to be at least essentially plane-surfaced or constituted by substantially flat or planar surfaces. On the one hand, these two outer half shells are fastened to the wheel hub and, in an at least substantially symmetrical arrangement to one another, radially extend from the wheel hub toward the exterior in a substantially conically inclined relationship toward one another. On the other hand, the two outer half shells abut or bear against one another at the circumference thereof by means of wall parts in a connecting plane, such wall parts forming the wheel rim.

By virtue of the tape wheel constructed according to the invention, there is achieved a transverse or axial stiffness or rigidity which symmetrically distributes the direction of force of the pressure of the weft thread insertion tape or strap upon the two outer half shells. The stiffness or rigidity of the entire wheel body is thus increased or improved for the weft thread insertion tape or strap. In this connection, the at least essentially symmetrical arrangement of the outer half shells with respect to one another means that these outer half shells are symmetrically or substantially symmetrically arranged. Furthermore, the tape or strap wheel constructed according to the invention is advantageously of a very simple construction and design, since the wheel body is simply structured of two outer half shells which are at least essentially plane-surfaced, i.e. constructed in plane-surfaced or essentially plane-surfaced manner.

Only one type of outer half shell is required for wheel constructed according to the invention. In other words, it is quite unnecessary to design and produce two different constructions of half shells, so that a particularly simple construction and production of the inventive tape wheel is ensured. Due to the substantially conically designed outer half shells there can be achieved a symmetrical stiffness or rigidity and the force direction of the pressure of the weft thread insertion tape can be symmetrically and thus uniformly distributed upon the tape wheel.

The two outer half shells are advantageously arranged at an angle in the range of 5° to 25° with respect to the connecting plane. At the abutting location of the outer half shells in the connecting plane there is provided a gap between the annular wall parts or portions. However, such annular wall parts can also overlap in or beyond the connecting plane.

Preferably, a supporting part serves as a fastening means for the outer half shells, and the gap can be spanned or bridged over by the supporting part. The outer half shells preferably bear against each other in the connecting plane by means of their respective or associated cone base.

In a particularly advantageous embodiment of the tape wheel there is preferably arranged between the two outer half shells a stiffening or bracing shell which is fastened to the wheel hub and diagonally extends away from this wheel hub toward the exterior and from the one outer half shell to the free end of the other opposite outer half shell. In this manner, the transverse or axial stiffness or rigidity of the wheel body and thus of the entire tape wheel can be further improved and the stiffening of the running or contact surface for the weft thread insertion tape can be particularly advantageously increased. A force transmission can be thus effected from one outer half shell via the stiffening or bracing shell to the wheel hub such that the outer half shells can be relieved of the pressure of the weft thread insertion tape or strap. This problem was hitherto solved by shells or, for example, by an asymmetrical arrangement of the outer half shells. It is known, for example, from Swiss Patent Application No. 601/85 filed Feb. 11, 1985, entitled: "RAD, INSBESONDERE BANDRAD FUER DEN SCHUSSEINTRAG AN EINER WEBMASCHINE", that the stiffness or rigidity can be improved by pockets or the like in the outer half shells. However, such a construction cannot meet aerodynamic requirements.

The stiffening or bracing shell advantageously intersects the connecting plane and is inclined at an angle in the range of 10° to 35° with respect to the connecting plane. Preferably, the stiffening or bracing shell extends along the shortest or direct path from the one outer half shell to the free end of the other opposite outer half shell. The stiffening or bracing shell can abut against and, for example, be fastened to the annular wall parts of the two outer half shells by means of an annular shell portion. The stiffening or bracing shell and the two outer half shells can be externally fastened to the wheel hub, whereby the fastening can be effected at a radially extending flange or flange member of the wheel hub. This flange can extend substantially perpendicular to the axis of rotation of the tape wheel, but can also extend inclinedly with respect to such axis of rotation.

BRIEF DESCRIPTION OF THE DRAWINGS

The invention will be better understood and objects other than those set forth above will become apparent when consideration is given to the following detailed description thereof. Such description makes reference to the annexed drawings, there has been generally used the same reference characters to denote the same or analogous components and wherein:

FIG. 3 schematically shows in a side view an exemplary embodiment of a part of a tape wheel for weft thread insertion at a weaving machine; and FIG. 4 schematically shows in a side view a further exemplary embodiment of a part of a tape wheel for weft thread insertion at a weaving machine.

DETAILED DESCRIPTION OF THE PREFERRED EMBODIMENTS

Figure 1:
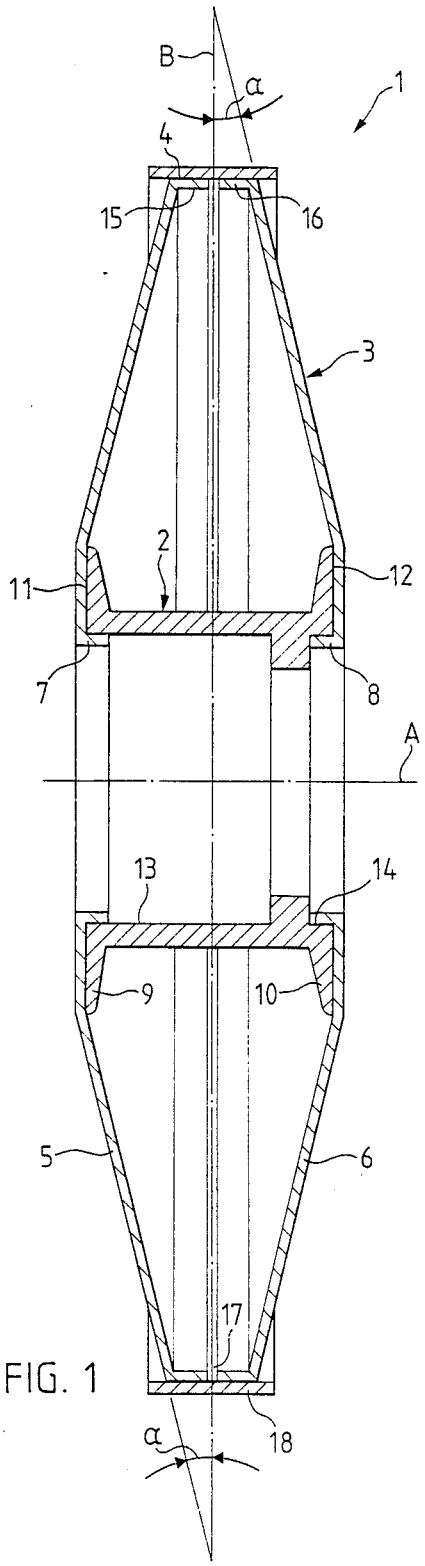
FIG. 1 schematically shows in a cross-sectional view a first exemplary embodiment of a tape wheel for weft thread insertion at a weaving machine.

Describing now the drawings, it is to be understood that to simplify the showing thereof only enough of the construction of the exemplary embodiments of the tape wheel for weft thread insertion at a weaving machine has been illustrated therein as is needed to enable one skilled in the art to readily understand the underlying principles and concepts of this invention. Turning attention now specifically to FIG. 1 of the drawings, the tape wheel 1 illustrated therein by way of example and not limitation will be seen to comprise a wheel hub 2 and a wheel body 3 having an outer wheel rim 4. The tape or strap wheel 1 can be rotatably mounted and suitably driven by appropriate drive means with the wheel hub 2 about its rotational axis A selectively in both directions of rotation.

The wheel body 3 is formed of two outer half shells 5 and 6, each of which is seated at and fastened to the wheel hub 2 by means of an inner band 7 and 8, respectively. The wheel hub 2 possesses for each of the two outer half shells 5 and 6 a flange 9 and 10, respectively, each having a supporting surface 11 and 12, respectively, as well as recesses 13 and 14 into which engages the respective inner band 7 and 8, respectively. From the associated flange 9 or 10 serving as the base of the wheel hub 2, the plane-surfaced or planar structured outer half shells 5 and 6 extend toward the exterior and are substantially conically inclined toward one another and in the direction of a connecting plane B in which the cone bases of the conical or cone-shaped outer half shells 5 and 6 are located.

The outer half shells 5 and 6 possess at their 16 which form the wheel rim 4 as an outer band. Furthermore, the wall parts or portions 15 and 16 abut against one another at the connecting plane B and a gap or space 17 is provided at their confronting or facing ends. Each outer half shell 5 and 6 is inclinedly arranged at an angle $\alpha$ with respect to the connecting plane B. Such angle $\alpha$ can be, for example, 15°.

At the wheel rim 4 there is arranged a supporting part or element 18 which serves to receive a weft thread insertion tape or strap not particularly shown in the drawings. This supporting part or element 18 bridges over or spans the gap 17 and is fastened to the wall parts or portions 15 and 16, so that the two outer half shells 5 and 6 are held together at this location. In order to fasten a weft thread insertion tape or strap for weft thread insertion at a weaving machine there is provided at the wheel body 3 a suitable fastening device which is thus here not particularly shown in the drawings. According to FIG. 2, in which the same reference characters are generally used to denote the same or analogous parts or components as for the exemplary embodiment illustrated in FIG. 1, there is provided a tape or strap wheel 20 having a wheel body 21 which again is fastened to the wheel hub 2. Within the wheel body 21 there is located between the two outer half shells 5 and 6 an inner stiffening or bracing shell or shell member 22 which is fastened to an inner band 23 at the wheel hub 2. The stiffening or bracing shell 22 laps or engages over the flange 10 and diagonally extends from that location toward the exterior from one outer half shell 6 to the outer end 24 of the other outer half shell 5. The stiffening or bracing shell 22 abuts against the annular wall parts or portions 15 and 16 of the two outer half shells 5 and 6 by means of an annular shell part or portion 25 and is connected at that location to the two outer half shells 5 and 6. The shell part or portion 25 is suitably flexed or bent away from the stiffening or bracing shell 22. The outer half shell 6 is located above the stiffening or bracing shell 22 at the flange 10 and engages with its inner band 8 into the recess 14 of the wheel hub 2. The stiffening or bracing shell 22 is inclined at an angle $\beta$ with respect to the connecting plane B. Such angle $\beta$ can be, for example, 19°.

Figure 2:
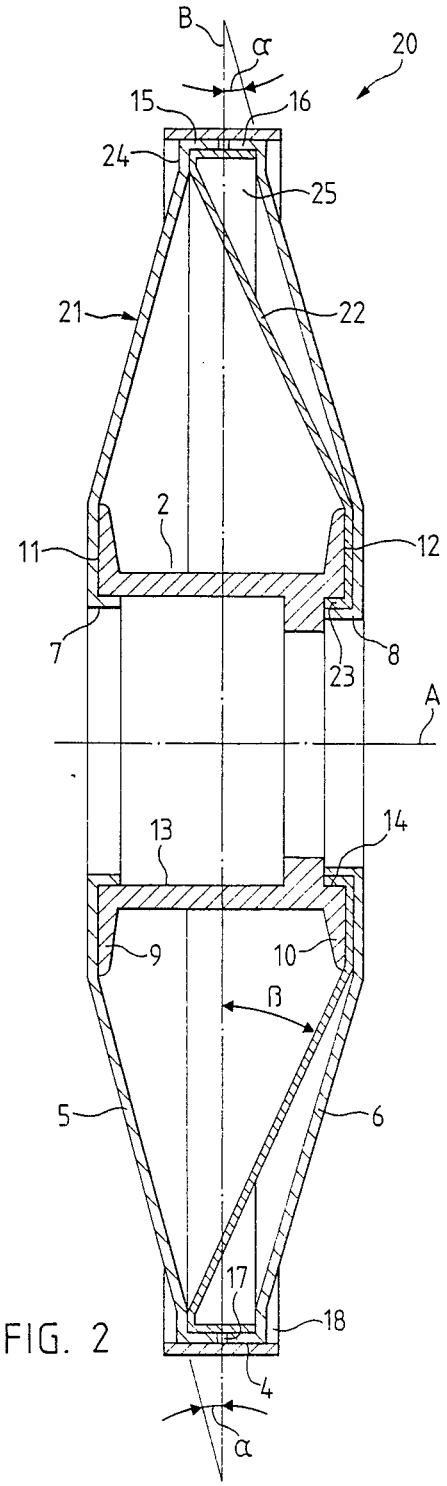
FIG. 2 schematically shows in a cross-sectional view a second exemplary embodiment of a tape wheel for weft thread insertion at a weaving machine.

By virtue of the stiffening or bracing shell 22 the transverse or axial stiffness or rigidity of the wheel body 21 and thus of the entire tape or strap wheel 20 is increased in a particularly advantageous manner, so that this inner stiffening or rigidizing provides an improved stiffening of the running or contact surface for the weft thread insertion tape which is not particularly shown in FIG. 2.

FIG. 3 shows a part of a tape or strap wheel 30 which can be generally structured in the manner of the exemplary embodiments depicted in FIGS. 1 and 2. An indentation or recess 32 is provided at the outer circumference of a wheel body 31. This indentation or recess 32 serves to receive one end 33 of a weft thread insertion tape or strap 34 which is appropriately held at the wheel body 31 by means of a suitable fastening device 35. This fastening device 35 is secured at the wheel body 31 by means of a screwed or threaded connection 36. The indentation or recess 32 is spanned or bridged over by means of a filling piece or portion or element 37. The tape or strap wheel 30 is selectively driveable in both possible directions of rotation about the rotational axis A as indicated by the double-headed arrow C. The exemplary embodiment of the tape or strap wheel shown in FIG. 3 can be afore-noted cross-referenced related U.S. patent application Ser. No. ....., filed ....., 1989, entitled "TAPE WHEEL FOR WEFT THREAD INSERTION AT A WEAVING MACHINE". In the exemplary embodiment described in this commonly assigned, copending U.S. application the annular wall parts of the wheel body 31 are not continuous.

In FIG. 4 there is shown a part of a tape wheel 40 which again can be generally structured in the same manner as the tape wheel shown in FIG. 1 or FIG. 2. The one end 41 of a weft thread insertion tape or strap 42 is fastened at the outer circumference of a wheel body 43 by means of a screw or thread bolt 44 or the like. The tape wheel 40 is selectively driveable about the rotational axis A in both possible directions of rotation as indicated by the double-headed arrow D.

With the tape wheel constructed according to the invention, the diameter thereof can be selected to be smaller than hitherto known in prior art tape wheels, depending on the use or application and/or on space requirements in the machine. In this manner, the mass moment of inertia and the rotative moment or the like can be essentially decreased, depending, for example, on the material and rotational radius.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A tape wheel for weft thread insertion at a weaving machine, comprising:

a wheel hub;

a wheel body having a wheel rim;

said wheel body being connected to said wheel hub;

a supporting part fastened to said wheel rim;

said supporting part serving to receive a weft thread insertion tape secured at the tape wheel;

said wheel body comprising two outer half shells which are structured to be at least essentially plane-surfaced;

said two outer half shells each comprising an outer circumference having an annular wall part;

said annular wall parts of said two outer half shells defining a mutual connecting plane;

said two outer half shells being fastened to said wheel hub and in an at least essentially symmetrical arrangement to one another radially extending from said wheel hub toward the exterior in a substantially conically inclined relationship toward one another;

said two outer half shells confronting one another at said outer circumferences by means of said annular wall parts in said connecting plane; and said annular wall parts of said two outer half shells constituting said wheel rim.

2. The tape wheel as defined in claim 1, wherein:

said two outer half shells are arranged at an angle in a range of 5° to 25° with respect to said connecting plane.

3. The tape wheel as defined in claim 2, further including:

an inner stiffening shell arranged within said wheel body and between said two outer half shells; and said inner stiffening shell being fastened at said wheel hub and diagonally extending from said wheel hub toward the exterior from one of said two outer half shells to a free end of the other one of said two outer half shells which is situated opposite said one half shell.

4. The tape wheel as defined in claim 3, wherein:

said inner stiffening shell intersects said connecting plane and extends along a shortest path from said one of said two outer half shells to said free end of said opposite one of said two outer half shells.

5. The tape wheel as defined in claim 4, wherein:

said inner stiffening shell possesses an annular shell portion; and said annular shell portion abutting against and being fastened to said annular wall parts of said two outer half shells.

6. The tape wheel as defined in claim 5, wherein:

said inner stiffening shell is arranged at an angle in a range of 10° to 35° with respect to said connecting plane.

7. The tape wheel as defined in claim 6, wherein:

said inner stiffening shell and said two outer half shells are externally fastened to said wheel hub.

8. The tape wheel as defined in claim 7, wherein:

said annular wall parts constituting cone base portions; and said two outer half shells adjoin one another in said connecting plane by means of said cone base portions.

9. The tape wheel as defined in claim 8, wherein:

said annular wall parts define a gap at the adjoining location of said two outer half shells.

10. The tape wheel as defined in claim 9, wherein:

said supporting part serves as a fastening means for said two outer half shells.

11. The tape wheel as defined in claim 10, wherein:

said two outer half shells are fastened to said supporting part and said inner stiffening shell.

* * * * *

UNITED STATES PATENT AND TRADEMARK OFFICE

CERTIFICATE OF CORRECTION

PATENT NO. : 4,865,084

DATED : September 12, 1989

INVENTOR(S) : HEINER KERN and RUDOLF HELLER

It is certified that error appears in the above-identified patent and that said Letters Patent is hereby corrected as shown below:

Column 1, line 32, after "sertion", please insert --at a weaving machine. The wheel body of this known tape wheel--

Column 2, line 27, before "wheel", please insert --the tape or strap--

Column 2, line 67, before "shells", please insert --reinforcement or another type of structuring of the outer half--

Column 3, line 30, after "drawings,", please insert --wherein throughout the various figures of the drawings,--

Column 4, line 10, after "their", please insert --outer circumference annular bent wall parts or portions 15 and--

Column 5, line 11, after "can be" please insert --structured in the manner as disclosed, for example, in the--

UNITED STATES PATENT AND TRADEMARK OFFICE

CERTIFICATE OF CORRECTION

PATENT NO. : 4,865,084

DATED : September 12, 1989

INVENTOR(S) : Heiner Kern and Rudolf Heller

It is certified that error appears in the above-identified patent and that said Letters Patent is hereby corrected as shown below:

Column 5, line 12, after "Ser. No." please delete "....." and insert --07/319,349-- and after "filed" please delete "....." and insert --March 6--

Signed and Sealed this

Twentieth Day of November, 1990

*Attest:*

HARRY F. MANBECK, JR.

*Attesting Officer*

*Commissioner of Patents and Trademarks*